United States Patent [19]

Kuboyama

[11] Patent Number: 4,457,083

[45] **Date of Patent: * Jul. 3, 1984**

[54] HEAT GENERATING APPARATUS AND ITS PROCESS

[76] Inventor: Nobuyoshi Kuboyama, 28-9-1, Shimomiyamori, Aza, Miyamorimura, Kamihei-Gun, Iwate-ken, Japan

[ * ] Notice: The portion of the term of this patent subsequent to Mar. 16, 1999 has been disclaimed.

[21] Appl. No.: 329,818

[22] Filed: Dec. 11, 1981

[30] Foreign Application Priority Data

Mar. 31, 1981 [JP] Japan ..... 56-46436

[51] Int. Cl.[3] ..... F26B 9/06

[52] U.S. Cl. ..... 34/92; 34/235; 126/247

[58] Field of Search ..... 37/15, 39, 92, 201, 37/218, 223, 224, 232, 230, 235; 126/247; 122/26

[56] References Cited

U.S. PATENT DOCUMENTS 3,140,929 7/1964 Johanson ..... 34/148

4,319,408 3/1982 Kuboyama ..... 34/15

*Primary Examiner*—Larry I. Schwartz

[57] ABSTRACT

This invention relates to a heat generating apparatus and its process which utilizes the air friction heat generated in a rotation area of a rotary means. The rotary means which is installed in a chamber as the heat generating apparatus is effective to reduce air pressure in the chamber to a reduced balanced level. In the meantime, the air friction heat generating means in the rotation area of the rotary means is actuated and the air friction heat is generated, thereby the interior of the chamber is heated rapidly. Due to increase in air temperature in the chamber, the chamber can be employed as a powerful heat source.

5 Claims, 7 Drawing Figures

HEAT GENERATING APPARATUS AND ITS PROCESS

BACKGROUND OF THE INVENTION

This invention relates to a heat generating apparatus and its process which utilizes the heat generation effect in reducing air pressure within a chamber at a balanced level.

Conventionally, there are known oil heaters, gas heaters, electric heaters and the like, each of which is employed for its respective purpose. A common disadvantage of them is that they consume large quantities of energy at a time when and enery cost is becoming more and more expensive. Particularly, the disadvantage of the electric heaters is that their thermal efficiency is low and power consumption is large and costly. Further, combustion of oil or coal or the like, besides being costly, also produces atmospheric pollution.

The principle of this invention is based upon U.S. patent application Ser. No. 200,563 now U.S. Pat. No. 4,319,408, entitled "Heating Process and Its Apparatus in Reducing Air Pressure within a Chamber at a Balanced Level" which was filed on Oct. 24, 1980 in U.S. Patent and Trademark Office, incorporated herein by reference, claiming the priorities of basic Japanese Patent Applications Nos. 55-94630, 55-94631, 55-132065 and 55-132066. The present invention represents a further novel element of the technical concept disclosed in the aforementioned U.S. patent application.

BRIEF SUMMARY OF THE INVENTION

It is an object of this invention to provide a heat generating apparatus and its process which make use of air friction heat which conventionally has not been usefully employed.

It is another object of this invention to provide a heat source apparatus and its process in which a heat accumulating material capable of accumulating heat energy is incorporated in a chamber of the apparatus, whereby the chamber itself can be used as a heat source.

It is another object of this invention to provide a heat generating apparatus and its process which can contribute to reducing energy consumption on a large scale.

Other and further objects, features and advantages of this invention will appear more fully from the following description taken in connection with the accompanying drawings.

DETAILED DESCRIPTION OF PREFERRED EMBODIMENT

Figure 1:
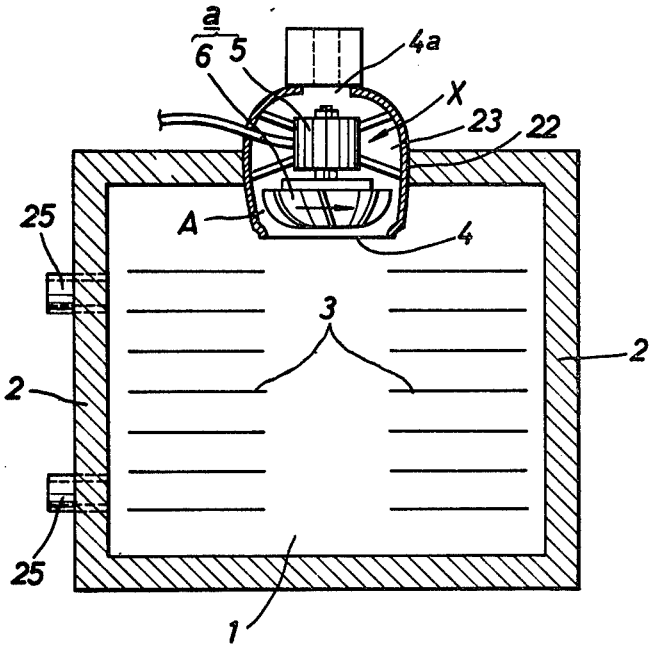
FIG. 1 is a cross section of a heat generating apparatus according to an embodiment this invention.

A preferred embodiment of this invention will now be described with reference to FIG. 1.

Numeral 1 is a closed chamber of square-cross at section which is shielded by four outer walls 2. The outer wall 2 is of a heat insulating and heat resisting structure. Numeral 3 is a heat accumulating material of preferred shape which may be incorporated in the chamber 1 as necessity arises. Numeral 4 is a suction opening which is mounted in a preferred wall of the chamber 1. The suction opening 4 is communicated with an air outlet 4*a*. In the suction opening 4 there is mounted an air friction heat generating means X having rotary means a. The air friction heat generating means X is effective to reduce air pressure within the chamber to a balanced level. The rotary means a is provided with a propeller fan or a sirocco fan or the like, each of which has a plurality of vanes 6 rotatable by a motor 5. Each vane 6 has a certain inclination so that air within the chamber 1 can be suctioned and discharged smoothly. In a rotation area of the rotary means a there is formed a friction heat generating area A where air is heated by friction. Preferably, the air friction heat generating means X is mounted more inwardly of the wall 2 of the chamber 1 in order to avoid escape of heat.

Another embodiment of this invention will now be described with reference to FIGS. 2 to 5. Since the same construction as shown in FIG. 1 has the same numerals, its description will be omitted.

Numeral 7 is a second rotary means or a rotary impeller which is spaced concentrically from the rotary means a of the air friction heat generating means X. The rotary impeller 7 constitutes trailing rotary means Y rotatable by the air viscosity effect due to rotation of the rotary means a. The trailing rotary means Y which is mounted on a support frame 9 has a plurality of vanes, each of which has a preferred pitch capable of suctioning upwardly air within the chamber 1.

Figure 2:
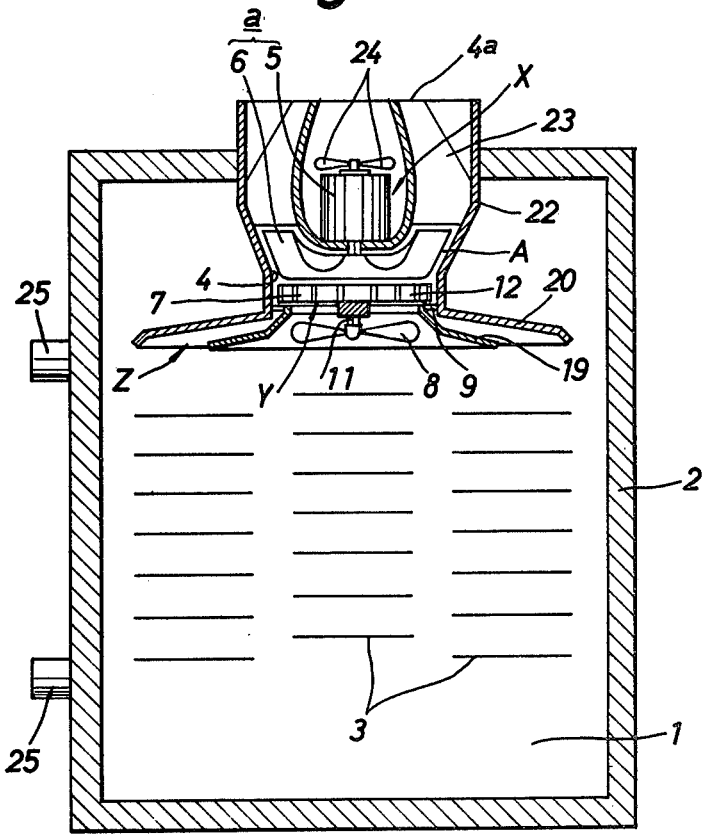
FIG. 2 is a cross section of a heat generating apparatus according to another embodiment of this invention.
Figure 3:
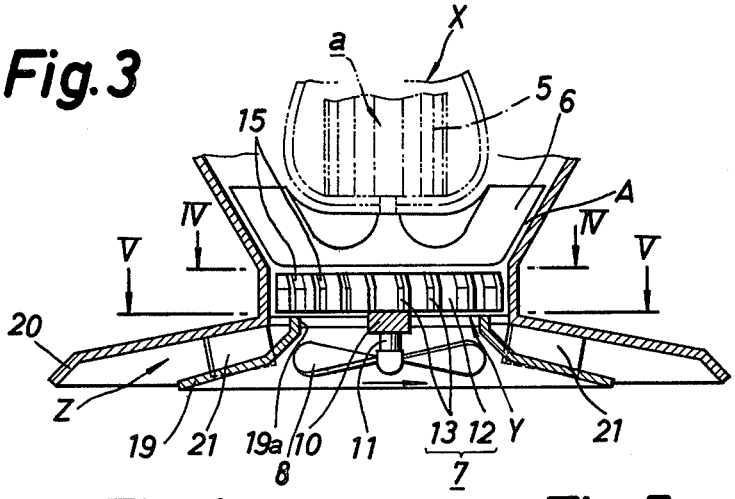
FIG. 3 is an expanded cross section of the rotary means of FIG. 2.
Figure 4:
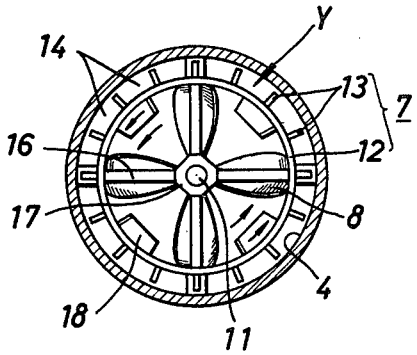
FIG. 4 is a cross section taken along line IV—IV of FIG. 3.
Figure 5:
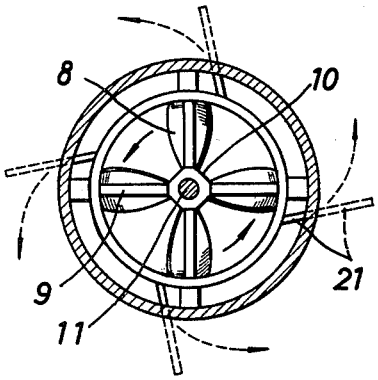
FIG. 5 is a cross section taken along line V—V of FIG. 3.

As shown in FIG. 2, the trailing rotary means Y comprises suction vane means 8 which is rotated coaxially with the rotary impeller means 7. So to speak, the trailing rotary means Y is a two-stage rotation structure.

Referring more in detail to the two-stage rotation structure, a cross-shaped support frame 9 is installed in a lower end of the suction opening 4 and a center of the support frame 9 is provided with a shaft bearing portion 10 so as to correspond with a center of the rotary means a. The second rotary impeller 7 is mounted above the shaft bearing portion 10 and fixed with a shaft 11, while the suction vane means 8 is mounted below the shaft bearing portion 10 and is fixed with the shaft 11. The rotary impeller 7 comprises a ring 12 having a diameter smaller than the diameter of the suction opening 4, and a plurality of vanes 13 which project externally from the ring 12. Thus, a large number of air cells 14 are formed by enclosure of an interior of the suction opening 4, the ring 12 and the plurality of vanes 13. Numeral 15 (FIG. 3) is a curvature portion of each vane 13 which is bent obliquely from an upper end thereof in order to increase rotation power. Numeral 16 is four bars of a central mounting means 17. Further, there are mounted a number of suction vanes 18 on the inner side of the ring 12 to suction air upwardly from within the chamber.

The suction vane means 8 may be a normal fan. What is more important is that its rotary vane is capable of upwardly suctioning air from within the chamber. The suction vane means 8 is covered by a nearly frusto-conal cover 19 of which an upper annular end is fixed to ends of the support frame 9. Thus, the suction area of the suction vane means 8 is defined by the frusto-conal cover 19.

Further, the frusto-conal cover 19 may be rotatably fixed with the shaft 11 and provided at its lower side with a plurality of vanes having the suction effect. Such a frusto-conal cover (not illustrated) having a plurality vanes has also a clearly defined suction area.

In this second embodiment there is formed guide means Z for causing forcible air circulation and convection in order to circulate effectively air flow within the chamber 1 and to maintain a uniform temperature distribution throughout the chamber. For this purpose, a frusto-conal guide cover 20 is extended downwardly from the end of the suction opening 4. Between the upper guide cover 20 and the lower cover 19 there are mounted a number of regulating plates 21 for regulating a direction of air flow.

In either FIG. 1 or FIG. 2 numeral 22 is a cylindrical case of the motor 5 which includes a rotation area of the rotary means a and an air discharge passage 23. Numeral 24 is a cooling fan for cooling the motor 5, which is fixed with a rotary shaft of the motor 5.

Further, the chamber 1 is provided, at its one side wall, with at least one opening 25 connectable to a pipe for feeding the heated air generated in the chamber 1. The opening 25 may be opened or closed as necessary.

Further, the motor 5 may be switched on or off manually or automatically in accordance with the setting temperature of the chamber 1. It is optional to mount temperature control means and other electrical control means.

Still further, the trailing rotary means Y may be of a three-stage or more rotary means.

Now, the operation of the heat generating apparatus of the first embodiment will be described.

When the motor 5 is energized, a plurality of vanes 6 are rotated. Then, the air friction heat generating means X is actuated. The air pressure within the chamber 1 is gradually reduced since air therewithin is suctioned forcibly and discharged outside the chamber 1 by rotation of the plurality of vanes 6. Difference between a reduced air pressure within the chamber 1 and a normal air pressure thereoutside gradually becomes larger, but after a short time the difference therebetween is maintained at a balanced level. The air pressure difference is defined by a suction force of the rotary means a and a gap scale between the suction opening 4 and the rotary vanes 6, but the difference between the reduced air pressure within the chamber 1 and the normal air pressure thereoutside is maintained at a balanced level as long as the vanes 6 are rotated continuously.

At the reduced balanced level of the air pressure an air retaining phenonmenon is generated in the friction heat generating area A where the vanes 6 are rotated. Since the vanes 6 are rotated continuously at high speed in that area A, air friction heat is generated and the air temperature is gradually raised. As the temperature of the interior of the chamber 1 is raised, heat energy is accumulated gradually in the heat accumulating material 3 incorporated in the chamber 1.

When a preferred temperature is obtained, the interior of the chamber 1 becomes a heat source by stopping the motor 5 and forcibly closing the air discharge passage 23 of the cylinder case. Accordingly, if articles are incorporated in the chamber 1, heating and drying of the articles is obtained. Further, if a pipe is connected to the opening 25 of the chamber 1 and heated air is supplied therefrom to another place, the chamber 1 performs as a very effective heat source.

When the temperature of the interior of the chamber falls to less than the selected temperature, the motor 5 may be energized again by a control means such as a thermostat, whereby air friction heat can again be generated.

The operation of the heat generating apparatus of the second embodiment will be described with reference to FIGS. 2 to 5.

When the rotary means a is rotated, the trailing rotary means Y positioned coaxially thereunder is rotated in the same direction by the heated air flow generated by the rotary vanes 6 of the rotary means a. And air within the chamber is discharged outside the chamber by rotation of the trailing rotary means Y exclusively until air pressure within the chamber is reduced to a balanced level, that is, a difference between the reduced air pressure within the chamber and the air pressure outside the chamber is maintained at the balanced level.

While the air pressure within the chamber is maintained at the balanced level, air within a large number of air cells 14 closed by the ring 12 of the rotary impeller 7, the vanes 13 and the inner side of the suction opening 4 is circulated forcibly by rotation of the impeller 7. Simultaneously, the suction rotary vane means 8 coaxially mounted beneath the impeller 7 is rotated in the same direction.

The heated air within the large number of air cells 14 is introduced into a space between the upper guide cover 20 and the lower cover 19 by way of a number of regulating plates 21 and supplied to the interior of the chamber 1.

The heated air beneath the suction rotary vane means 8 is suctioned upwardly from downwardly by rotation of the suction vane means 8 to be driven integrally by rotation of the rotary impeller 7. The upward suction of the heated air is assisted by the suction effect of the suction vanes 18 mounted on an inner side of the ring 12. Thus, the air migrates forcibly back into the friction heat generating area A. The air is again heated by rotation of the rotary vanes 6 of the friction heat generating area A and discharged into the interior of the chamber by the rotary impeller.

Accordingly, by cooperation of the trailing rotary means Y and the guide means Z for causing forcible air circulation and convection, the air within the chamber 1 is forcibly circulated from the top of the chamber through the inner periphery thereof into the interior thereof and migrates back from the center of the chamber 1 into the air friction heat generating means X. The air flow is characterized by forcible convective flow and spiral vortex flow.

Owing to air circulation from up to down and from down to up, the temperature of the heated air throughout the chamber 1 can be rapidly and uniformly raised to a desired temperature. In addition, the heated air which is circulated effectively gives uniform heat to the heat accumulating material 3 mounted in the chamber 1, whereby the heat accumulating material can accumulate a large quantity heat energy.

Although the illustrated and described embodiments of the chamber are of rectangular cross section, the shape itself is not a feature of the invention. Other shapes such as a cylinder and the like may also be used.

When the chamber is a cubic structure, each corner thereof may be curved in order to decrease air flow resistance.

Further, although the chamber 1 is of a heat resisting structure in the embodiments, it may be made of a heat conducting metal. In this case, the chamber itself may become a heat source which can radiate heat.

Further, it is possible to mount in the chamber two or more air friction heat generating means in which air friction heat is generated by the rotary means a.

Figure 6:
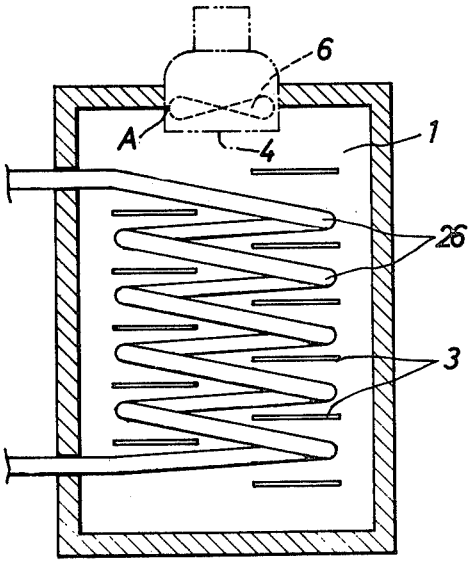
FIG. 6 is a cross section of a heat generating apparatus according to a further embodiment of this invention.

FIG. 6 is another embodiment of the heat generating apparatus according to this invention, in which a conduit 26 is coiled and a preferred heat medium is stored in the coiled conduit 26. Accordingly, the heat medium in the coiled conduit 26 mounted within the chamber 1 may be supplied to a preferred outside place. The principle and process of heat generation in this embodiment are the same as those in the former embodiments.

Figure 7:
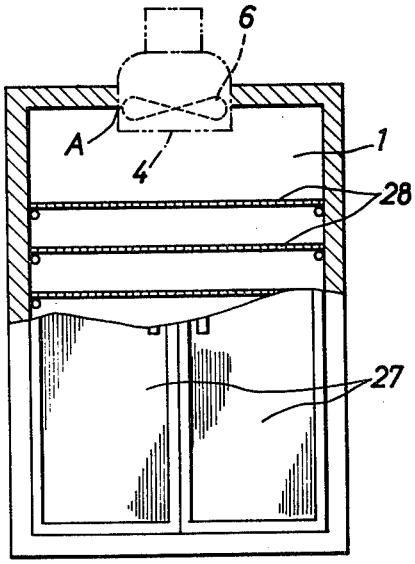
FIG. 7 is a front view of a heat generating apparatus according to a still further embodiment of this invention.

FIG. 7 is another embodiment of the heat generating apparatus of this invention. As necessity arises, it is possible to mount a pair of doors 27 for opening and closing on a front wall of the chamber 1 and a plurality of perforated shelves 28 therein for placing articles to be heated or dried.

Thus, the air friction heat is accumulated within the chamber and if necessity arises, the air friction heat may be accumulated as heat energy in the heat accumulating material. Accordingly, heat capacity within the chamber can be expanded by as much as ten to several hundred times as a result of heat accumulation.

According to another aspect of this invention, since the air convection function and the spiral vortex function are actuated within the chamber by a joint cooperation of the trailing rotary means Y and the guide means Z for causing forcible air circulation and convection, it is very easy to obtain a uniform temperature increase and distribution throughout the interior of the chamber.

According to a further aspect of this invention, the heat energy accumulated in the chamber can be applied for various fields such as burning, warming, drying, heating, etc. by making a direct use of the chamber itself or taking the heat energy out of the chamber.

What is claimed is:

1. A heat generating apparatus for generating heat, comprising:

a chamber;

said chamber being sealed against entry of air;

an air outlet in said chamber;

an air suction opening in said outlet of said chamber;

rotary means mounted in said air suction opening effective to reduce air pressure in said chamber to a reduced balanced level by forcibly suctioning air from said chamber and discharging said air outside said sealed chamber;

an air friction heat generating means in a rotation area of the rotary means, said air friction heat generating means being effective to add heat to air remaining in said chamber; and means for maintaining said air pressure in said chamber at said reduced balanced level whereby air remaining in the interior of said chamber is heated by air friction heat at said reduced balanced air pressure.

2. A heat generating apparatus according to claim 1, further comprising a heat accumulating material incorporated within said chamber.

3. A heat generating apparatus for generating heat within a chamber at a reduced air pressure, said chamber having an air outlet, comprising:

an air suction opening in said outlet of said chamber;

rotary means mounted in said air suction opening effective to reduce air pressure in said chamber to a reduced balanced level by forcibly suctioning air from said chamber and discharging said air outside said sealed chamber;

an air friction heat generating means in a rotation area of the rotary means, said air friction heat generating means being effective to add heat to air remaining in said chamber;

means for maintaining said air pressure in said chamber at said reduced balanced level whereby air remaining in the interior of said chamber is heated by air friction heat at said reduced balanced air pressure;

trailing rotary means beneath said air friction heat generating means; and guide means for causing forcible circulation and convection, thereby air temperature within said chamber is increased uniformly and said chamber itself is effective as a heat source.

4. A heat generating apparatus according to claim 3, further comprising a heat accumulating material incorporated within said chamber.

5. A heat generating process for generating heat within a chamber at a reduced air pressure, said chamber having an air outlet, comprising:

sealing said chamber against entry of air;

forcibly suctioning air from within said chamber by rotary means at said air outlet;

discharging forcibly suctioned air outside said chamber by rotation of said rotary means until air pressure within the chamber is reduced to a balanced level;

maintaining a difference between the reduced air pressure within said chamber and the air pressure outside said chamber at said balanced level; and generating air friction heat by continuous rotation of the rotary means, and permitting a substantial portion of said air friction heat to remain inside said chamber whereby said inside of said chamber is heated by the air friction heat at said reduced air pressure.

* * * * *